US009097004B2

(12) United States Patent
Yau

(10) Patent No.: US 9,097,004 B2
(45) Date of Patent: Aug. 4, 2015

(54) COMBINED PRE-EMBEDDED ANCHORING SLOT SYSTEM

(76) Inventor: Pak Sum Yau, Tsuen Wan (HK)

( * ) Notice: Subject to any disclaimer, the term of this patent is extended or adjusted under 35 U.S.C. 154(b) by 12 days.

(21) Appl. No.: 14/238,184

(22) PCT Filed: Aug. 10, 2011

(86) PCT No.: PCT/CN2011/078236

§ 371 (c)(1),
(2), (4) Date: Feb. 10, 2014

(87) PCT Pub. No.: WO2013/020287

PCT Pub. Date: Feb. 14, 2013

(65) Prior Publication Data

US 2014/0208678 A1 Jul. 31, 2014

(51) Int. Cl.

| | |
|---|---|
| ***E04B 1/41*** | (2006.01) |
| ***E04C 5/16*** | (2006.01) |
| *E04B 2/96* | (2006.01) |

(52) U.S. Cl.

CPC ..... *E04B 1/4114* (2013.01); *E04B 1/4107* (2013.01); *E04C 5/166* (2013.01); *E04B 2/96* (2013.01)

(58) Field of Classification Search

CPC ..... E04B 1/4107; E04B 1/4114; E04B 2/96; E04C 5/166

USPC ..... 52/704, 707, 710; 38/704, 707, 710

See application file for complete search history.

(56) References Cited

U.S. PATENT DOCUMENTS

| | | | | |
|---|---|---|---|---|
| 4,130,977 | A | 12/1978 | Taylor, Jr. et al. | |
| 4,948,313 | A * | 8/1990 | Zankovich | 411/85 |
| 5,561,956 | A * | 10/1996 | Englekirk et al. | 52/223.13 |
| 8,397,467 | B2 * | 3/2013 | Krell | 52/745.11 |
| 2002/0078657 | A1 * | 6/2002 | Zambelli et al. | 52/710 |
| 2011/0173920 | A1 * | 7/2011 | Yau | 52/710 |

FOREIGN PATENT DOCUMENTS

| | | |
|---|---|---|
| CN | 201649370 | 12/2009 |
| EP | 1764448 | 3/2007 |
| KR | 20100113901 | 10/2010 |

* cited by examiner

*Primary Examiner* — Andrew J Triggs
(74) *Attorney, Agent, or Firm* — Cislo & Thomas, LLP

(57) ABSTRACT

The present application relates to a pre-embedded anchor system for securing construction elements to concrete slabs. The system comprises at least one pair of juxtaposed elongate anchor slots (1) connected together by at least two linkage bolts (8) and an assembly of steel bars (2) interconnecting a plurality of anchor members (3) at connection nodes (7) of the anchor members (3). The anchor slots (1) have a plurality of anchor members (3) extending therefrom. The pair of juxtaposed anchor slots (1) are interconnected by the linkage bolts (8) and the assembly of crossover steel bars (2) to form a frame.

9 Claims, 6 Drawing Sheets

COMBINED PRE-EMBEDDED ANCHORING SLOT SYSTEM

This patent application is a national phase entry of PCT Application No.: PCT/CN2011/078236, filed Aug. 10, 2011, which is incorporated in its entirety here by this reference.

FIELD OF THE INVENTION

The present application relates to a combined metallic pre-embedded anchor slot system used in the construction industry, particularly, a pre-embedded anchor slot system for use in reinforced concrete floor slabs with corrugated steel decking or thin reinforced concrete floor slab.

BACKGROUND OF THE INVENTION

Designers of modern architectures widely adopt the use of corrugated steel decking with reinforced concrete topping or thin concrete floor slab, with thickness typically ranges from 125 mm to 150 mm. However, due to the reduction of thickness of the floor slab, the embedded anchor slot which relies on attaching to the concrete structure results in a lower loading capacity for external objects.

In modern high-rise architectures, structural steelwork is typically used as primary structural frame of buildings. Corrugated steel decking with reinforced concrete topping are used to form floor slabs with thickness of mere 125 mm-150 mm. Besides, architects aims to minimize the thickness of floor slabs in order to reduce overall construction costs. In view of the above, the pursuit of combined anchor slot system has become a goal for the construction industry.

SUMMARY OF THE INVENTION

The present application is directed to a combined pre-embedded anchor slot system to be used in the construction industry.

The object of the present application is to provide a combined embedded anchor slot system which alleviates the technical difficulties discussed in the prior art, by embedding the system in concrete slab with corrugated steel decking or thin traditional reinforced concrete slab of a concrete structural by utilizing anchor studs and reinforcing steel bars which secured into concrete structure to exert external loads transmitted from the serrated nut.

There is provided a combined pre-embedded anchor slot system comprising an anchor slot, a linkage bolt, a set nut, a anchor stud, a reinforcing steel bar, and a serrated nut, wherein the said combined embedded anchor slot system further comprises one or more pair of juxtaposed anchor slots, linkage bolt and set nut which are mounted at each end of the anchor slot. The anchor stud is provided at the bottom of the anchor slot and connects to a connection node. A reinforcing steel bar is installed between every two connection nodes forming a combined structure of crossover reinforcing steel bars. One end of the anchor slot is provided with a nut access port and an end cap. The opposite end of the anchor slot is also provided with an end cap and a nut position limiting member which is disposed inside the anchor slot. The serrated nut accesses the anchor slot through the nut access port, wherein one or more serrated nut is installed into the channel rail. The combined pre-embedded anchor slot system forms a frame structure by linking one or more pair of juxtaposed anchor slots together with linkage bolts and a combined body of crossover reinforcing steel bars.

There is provided a combined pre-embedded anchor slot system wherein the anchor stud is provided at the bottom of the anchor slot, or at the center of the anchor slot.

There is provided a combined pre-embedded anchor slot system wherein one or more serrated nut is provided inside each anchor slot.

There is provided a combined pre-embedded anchor slot system wherein the serrated nut is marked with a centre line for aiding the user to carry out positioning of external attachment.

There is provided a combined pre-embedded anchor slot system wherein a set screw is provided on the serrated nut.

There is provided a combined pre-embedded anchor slot system wherein the serrated nut is interchangeable with a serrated T bolt.

There is provided a combined pre-embedded anchor slot system wherein the width of the nut access port of the anchor slot is greater than that of the slot opening.

There is provided a combined pre-embedded anchor slot system wherein the nut position limiting member is located close to the ends of the anchor slot.

There is provided a combined pre-embedded anchor slot system wherein adjustments and tightening of the spacing between the pair of anchor slots can be made by adjusting the linkage bolt and set nut.

The present invention utilizes the above technical features and provides a combined embedded anchor slot system which alleviates the technical difficulties discussed in the prior art, by embedding the system in concrete slab with corrugated steel decking or thin traditional reinforced concrete slab of a concrete structural by utilizing anchor studs and reinforcing steel bars which secured into concrete structure to exert external loads transmitted from the serrated nut. In comparison with the prior art, the combined pre-embedded anchor slot system offers exceptional stability.

The present invention provides a combined structure of at least a pair of anchor slot embedded in concrete slab. The assembly of anchor studs and longitudinally and laterally arranged reinforcing steel bars enhances the grip between the anchor system and the concrete slab as well as the loading capacity for external constructions. On the other hand, the position limiting member serves to prevent the anchor slot from being pried open under loads, hence avoiding the mounting bolt from being plucked out of the anchor slot which causes the structure to become unstable.

The combined pre-embedded anchor slot system of the present invention consumes lesser materials, hence is more cost effective and environmentally friendly.

DETAILED DESCRIPTION OF THE INVENTION

Preferred Embodiment of the Present Invention

The present invention will be described below in detail with reference to the preferred embodiment and the accompanied drawings.

Figure 1:
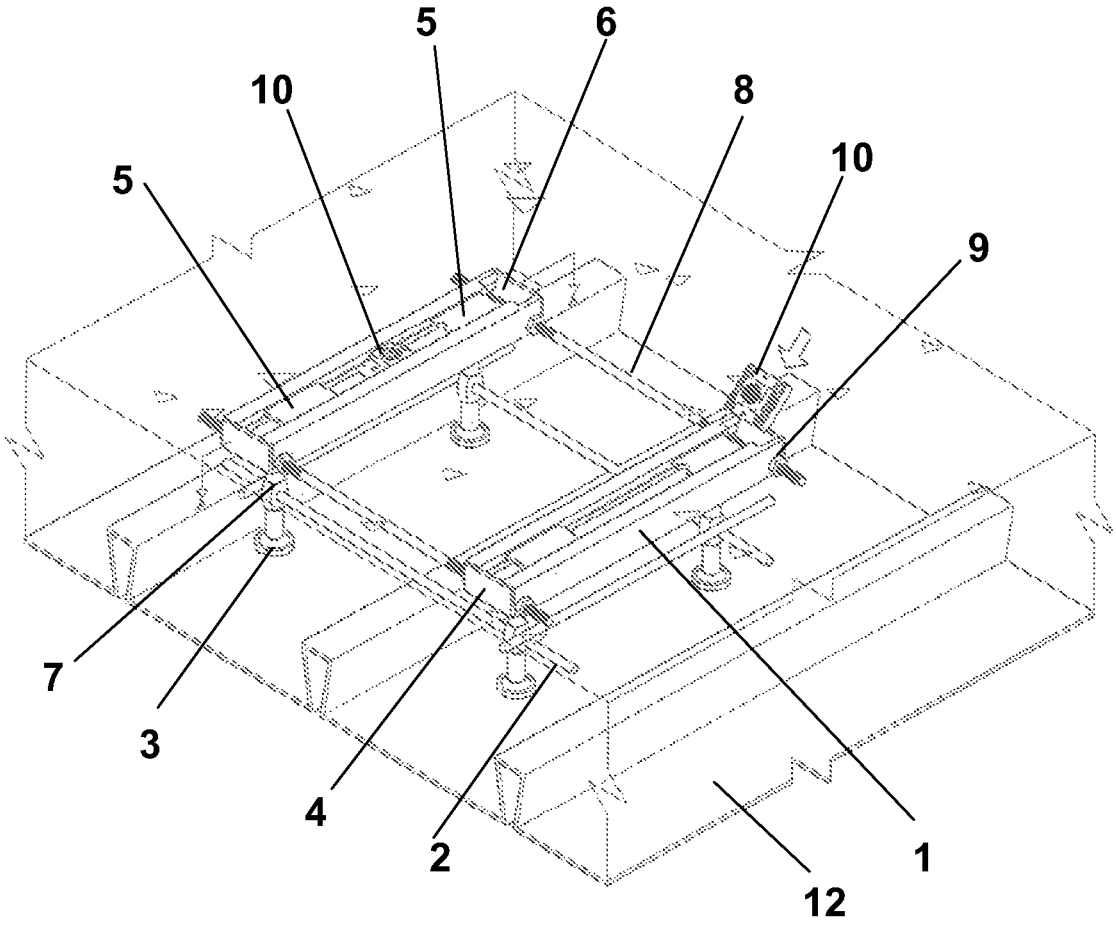
FIG. 1 is a structural representation of a combined pre-embedded anchor slot system of the present application embedded in the concrete slab with corrugated steel decking.
Figure 2:
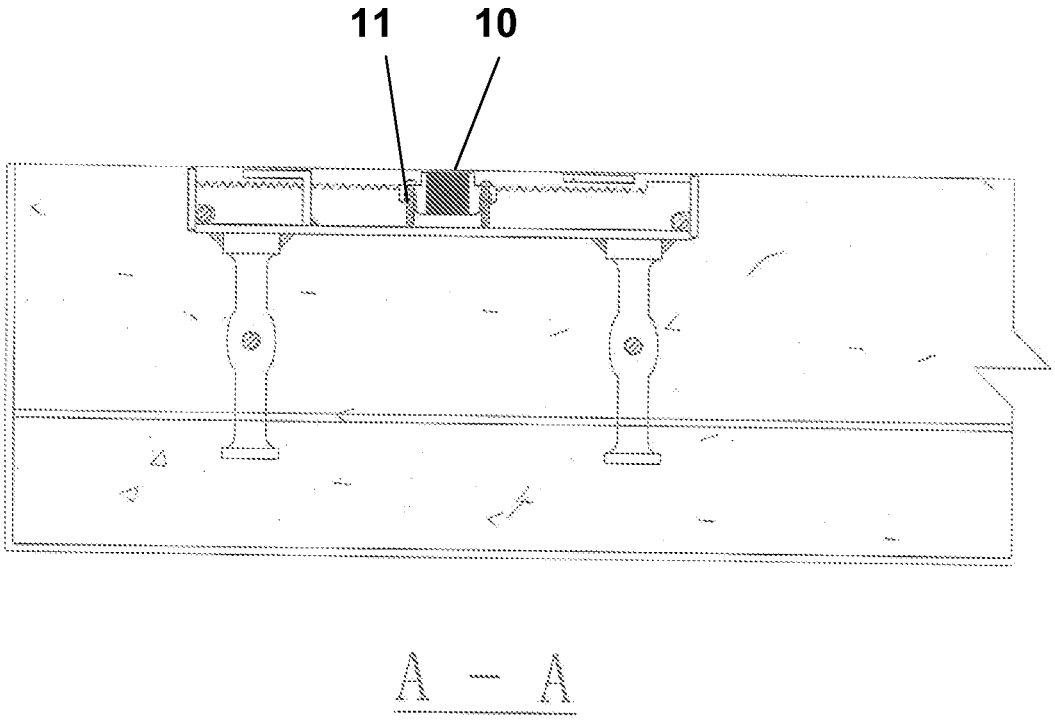
FIG. 2 is a representation showing a sectional view along line A-A in FIG. 1.
Figure 3:
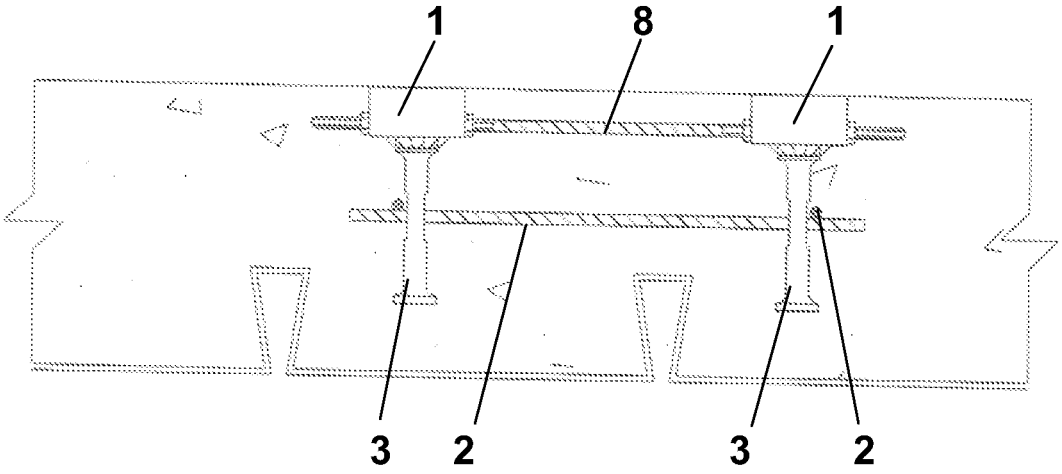
FIG. 3 is a representation showing a front view of FIG. 1.

Referring to FIG. 1 to FIG. 3, the present invention is aimed to provide a combined pre-embedded anchor slot system for use in the construction industry, which mainly includes an anchor slot 1, linkage bolts 8, set nuts 9, anchor studs 3 and connection nodes 7, reinforcing steelbars 2, and serrated nuts 10. The system is pre-embedded in concrete slab with steel corrugated decking 12.

The combined pre-embedded anchor slot system is formed by one or more pair of juxtaposed anchor slots 1, linked together at the corresponding ends with linkage bolts 8 and set nuts 9. Anchor studs 3 are provided at the bottom of the anchor slot 1 extending from the web of the anchor slot 1. As depicted in the figures, the anchor studs 3 are situated on both sides of the web and disposed along the lengthwise direction of the anchor slot 1. The anchor studs 3 are embedded in the concrete which prevents the anchor slot from being plucked from the concrete under external loads.

The anchor stud 3 is provided with a connection node 7. A reinforcing steel bar 2 is installed between two connection nodes 7 along the direction of the anchor slot, as well as in the direction across two anchor slots. As a result, a combined body of crossover reinforcing steel bars 2 is formed by the longitudinally and laterally arranged reinforcing steel bars 2.

At one end of the anchor slot 1, there is provided a nut access port 6 and an end cap 4. Another end cap 4 is provided at the opposite end of the anchor slot 1. A nut position limiting member 5 is mounted in proximate to each opposite end of the anchor slot 1. A serrated nut 10 is inserted into the anchor slot 1 through the nut access port 6. The number of serrated nut 10 to be fitted into the anchor slot 1 can be one, two or even three. The serrated nuts 10 are mounted inside the anchor slot 1.

The serrated nut 10 is marked with a centre line for aiding the user to carry out positioning of external attachment. Set screws 11 are provided on the serrated nut 10 to allow its position to be fixed. The position locking is achieved by driving in the set screws 11 which in turn pushes the serrated nut 10 up against the bottom surface of the foot flange. As a result, the serrations on the serrated nut 10 meshes with the serrations disposed on the bottom surface of the foot flange, therefore, locking the serrated nut 10 in place. The serrated nut 10 may be replaced with serrated T bolts.

The width of the nut access port 6 is greater than the width of the anchor slot 1 opening for allowing the serrated nut 10 to access through. The anchor slot 1 is also provided with a nut positioning reinforcement member 5 near each opposite end of the anchor slot 1. The above serves to limit the position range of the serrated nuts 10 and also prevents the anchor slot 1 from being pried open under external loads.

Figure 4:
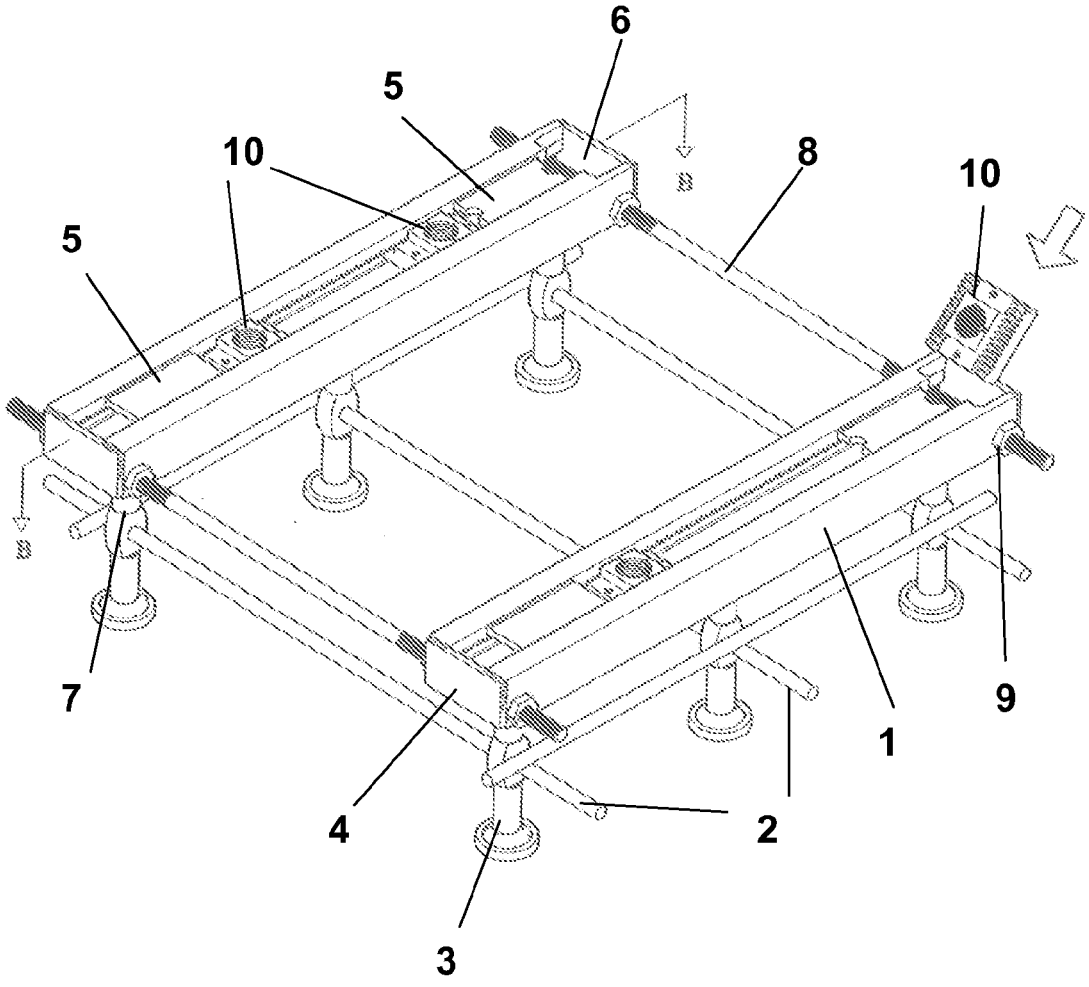
FIG. 4 is a representation of another embodiment of the present application.
Figure 5:
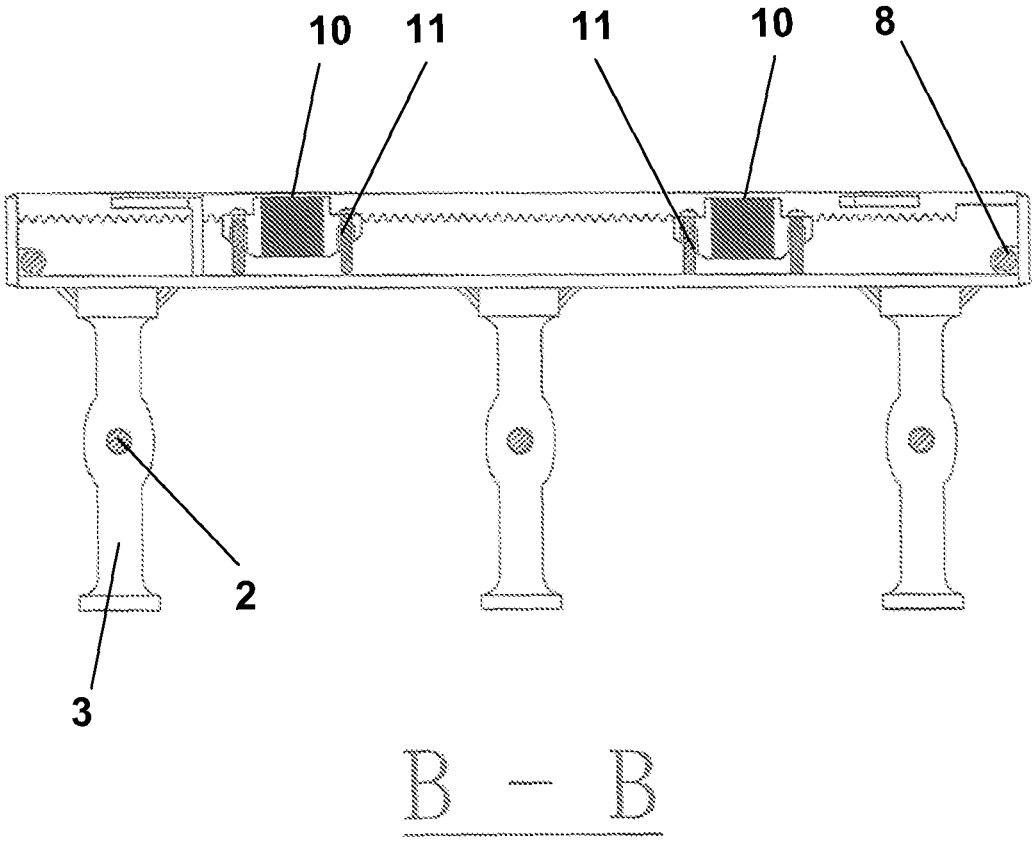
FIG. 5 is a representation showing a sectional view along line B-B in FIG. 4.

FIGS. 4 to 5 shows another embodiment of the combined pre-embedded anchor slot system which is primarily formed by the anchor slot 1, linkage bolt 8, set nut 9, anchor stud 9 and connection node 7, reinforcing steel bar 2 and serrated nut 10.

The combined pre-embedded anchor slot system consists of one or more pairs of the aforementioned juxtaposed anchor slots 1. A linkage bolt 8 and set nuts 9 are mounted on each opposite end of the anchor slot 1. As shown in the figures, the anchor studs 3 are provided near the opposite ends and also at the centre of the anchor slot 1, and are disposed on the web and along the lengthwise direction of the anchor slot 1. The anchor studs 3 are embedded in the concrete which prevents the anchor slot 1 from being plucked from the concrete under external loads.

The anchor stud 3 is connected to an anchor stud connection node 7. A reinforcing steel bar 2 is installed between two connection nodes 7. As shown in the figures, three connection nodes 7 are disposed along the lengthwise direction of anchor slot 1 and are linked by reinforcing steel bars 2. In addition to the two linkage bolts 8 connecting the two juxtaposed anchor slots 1, the anchor slots 1 are also linked by two reinforcing steel bars 2. As a result, a combined body of crossover reinforcing steel bars 2 is formed by the longitudinally and laterally arranged reinforcing steel bars 2.

One end of the anchor slot 1 is provided with a nut access port 6 and a sealing cap 4. Another sealing cap 4 is provided at the opposite end of the anchor slot 1. A position limiting member 5 is provided inside the anchor slot 1. A serrated nut 10 is inserted into the anchor slot 1 through the nut access port 6. As shown in the figures, two serrated nuts 10 inserted in each of the anchor slots 1.

The serrated nut 10 is marked with a centre line for aiding the user to carry out positioning of external attachment. Set screws 11 are provided on the serrated nut 10 to allow its position to be fixed. The position locking is achieved by driving in the set screws 11 which in turn pushes the serrated nut 10 up against the bottom surface of the foot flange. As a result, the serrations on the serrated nut 10 meshes with the serrations disposed on the bottom surface of the foot flange, therefore, locking the serrated nut 10 in place. The serrated nut 10 may be replaced with serrated T bolts.

The width of the nut access port 6 is greater than the width of the anchor slot 1 opening for allowing the serrated nut 10 to access through. The anchor slot 1 is also provided with a nut positioning reinforcement member 5 near each opposite end of the anchor slot 1. The above setup serves to limit the position range of the serrated nuts 10 and also prevent the anchor slot 1 from being pried open under external loads.

INDUSTRIAL APPLICATION OF THE PRESENT INVENTION

Figure 6:
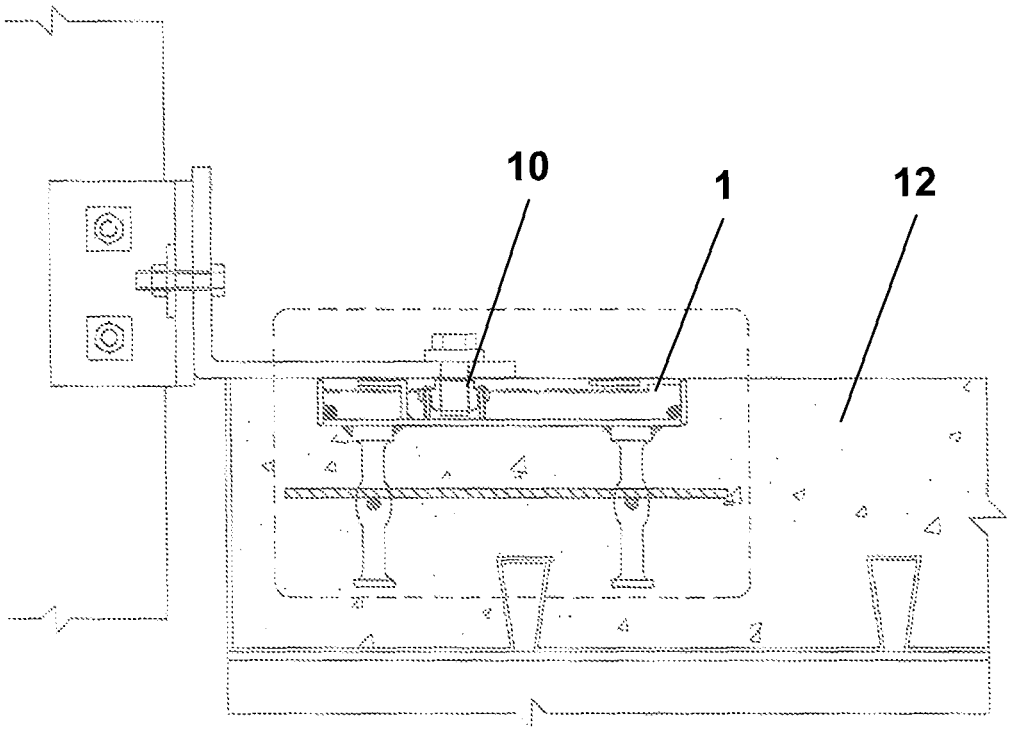
FIG. 6 is a representation showing the side view of a combined pre-embedded anchor system in application.
Figure 7:
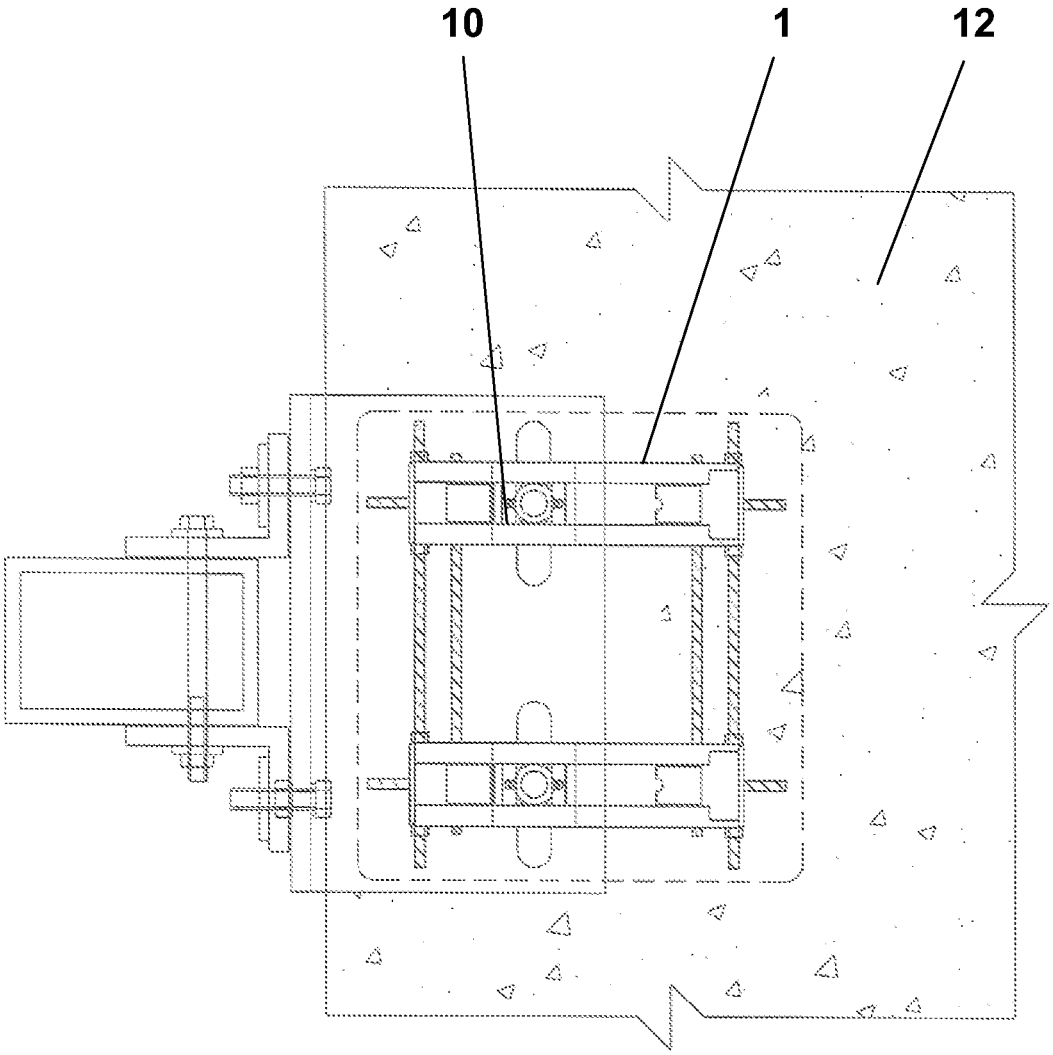
FIG. 7 is a representation showing the plan view of FIG. 6.

Referring to FIG. 6 and FIG. 7, the figures illustrate an application of a combined pre-embedded anchor slot system of the present invention. The combined pre-embedded anchor slot system is embedded in the concrete slab with corrugated steel decking 12 of a concrete structure.

The combined anchor pre-embedded anchor slot system of the present invention incorporates two or more anchor slots 1 interconnected by linkage rods 8 secured with set nuts 9, and the longitudinal and laterally arranged reinforcing steel bars 2 to collaboratively form a combined frame structure, which offers superior stability for the whole embedded anchor slot system, particularly for embedding such system in thin concrete slab with corrugated steel decking or thin traditional reinforced concrete slab. By utilizing anchor studs 3 and reinforcing steel bars 2 which secured into concrete structure to exert external loads transmitted from the serrated nut 10, exceptional stability can be attained.

The combined pre-embedded anchor slot system of the present invention provides adjustments of the spacing between the juxtaposed anchor slots 1 by adjusting and tightening the linkage bolts 8 and set nuts 9.

As described in the foregoing, the combined pre-embedded anchor slot system of the present invention can be embedded in concrete slab with corrugated steel decking or thin traditional reinforced concrete slab of a concrete structural by utilizing anchor studs and reinforcing steel bars which secured into concrete structure to exert external loads transmitted from the serrated nut, the combined pre-embedded anchor slot system offers exceptional stability. In the system, two or more anchor slots are interconnected by linkage bolts secured with set nuts. With the longitudinal and laterally arranged reinforcing steel bars, the system forms a frame structure and the grip between the system and the concrete structure as well as the loading capacity of external loads on the concrete structure can be maximized. The combined pre-embedded anchor slot system of the present invention consumes lesser materials, hence is more cost effective and environmentally friendly.

Of course, the skilled person in the art would appreciate that the above serves only to illustrate the embodiments but not as limitations to the invention disclosed. Any modification, equivalent, and alternative within the spirits of the invention would fall within the scope of the disclosure as defined by the appended claims.

What is claimed is:

1. A combined embedded anchoring groove system for embedding in concrete, comprising:

one or more pairs of juxtaposed elongate embedded anchoring grooves;

a connecting screw;

a positioning nut;

at least two anchor studs with anchor stud connection nodes;

steel reinforcement bars; and serrated nuts, wherein each elongate embedded anchoring groove has opposing ends, wherein the ends of each of the elongate embedded anchoring grooves are installed with the connecting screw and the positioning nut;

wherein the anchor studs extend from the elongate embedded anchoring grooves, the anchor studs being connected to the anchor stud connection nodes, and between each of the anchor stud connection nodes is mounted at least one of the steel reinforcement bars on as to form a vertically and horizontally connected steel reinforcement assembly;

wherein at one end of the elongate embedded anchoring grooves is a serrated nut access port and a first sealing cap, and at the other end of the elongate embedded anchoring grooves is a second sealing cap, with the elongate embedded anchoring grooves configured to receive position limiting reinforcement members;

wherein the serrated nuts are configured for insertion into the serrated nut access port of each of the elongate embedded anchoring grooves so that one or more serrated nuts are disposed inside each of the elongate embedded anchoring grooves;

wherein the embedded anchoring groove system is assembled by connecting one or more pairs of juxtaposed elongate embedded anchoring groove and interconnecting the connecting screw, and the vertically and horizontally connected steel reinforcement assembly forming a frame structure.

2. The combined embedded anchoring groove system claimed in claim 1, characterized in that the anchor studs are disposed at a side of each of the elongate embedded anchoring grooves.

3. The combined embedded anchoring groove system as claimed in claim 2, characterized in that the anchor studs are disposed at a middle of the elongate embedded anchoring grooves.

4. The combined embedded anchoring groove system as claimed in claim 1, characterized in that one, two or three serrated nuts are arranged inside each of the elongate embedded anchoring grooves.

5. The combined embedded anchoring groove system as claimed in claim 1, characterized in that the serrated nut is carved with a center line for positioning of an attached construction element.

6. The combined embedded anchoring groove system as claimed in claim 1, characterized in that the serrated nut includes a number of nut locking screws.

7. The combined embedded anchoring groove system as claimed in claim 1, characterized in that the serrated nuts can be replaced by serrated T bolts.

8. The combined embedded anchoring groove system as claimed in claim 1, characterized in that the position limiting reinforcement plate is disposed at sides of the elongate embedded anchoring move.

9. The combined embedded anchoring groove system as claimed in claim 1, characterized in that the spacing between the elongate embedded anchoring grooves are adjusted and fixed through the connecting screw and positioning nut.

* * * * *